US006662883B2

(12) United States Patent
Bonkowski

(10) Patent No.: US 6,662,883 B2
(45) Date of Patent: Dec. 16, 2003

(54) CHARGE TUBE ASSEMBLY FOR A PERFORATING GUN

(75) Inventor: Ralf Bonkowski, Edmonton (CA)

(73) Assignee: LRI Oil Tools Inc., Edmonton (CA)

( * ) Notice: Subject to any disclaimer, the term of this patent is extended or adjusted under 35 U.S.C. 154(b) by 0 days.

(21) Appl. No.: 10/014,302

(22) Filed: Nov. 13, 2001

(65) Prior Publication Data

US 2003/0047358 A1 Mar. 13, 2003

(51) Int. Cl.[7] ..... E21B 43/11
(52) U.S. Cl. ..... 175/4.56; 175/4.6; 166/55
(58) Field of Search ..... 175/4.56, 4.6; 166/297, 298, 55, 55.1

(56) References Cited

U.S. PATENT DOCUMENTS

| | | | | |
|---|---|---|---|---|
| 2,649,046 | A | 8/1953 | Davis | 102/20 |
| 2,708,408 | A | 5/1955 | Sweetman | 102/20 |
| 2,766,690 | A | 10/1956 | Lebourg | 102/20 |
| 2,873,675 | A | 2/1959 | Lebourg | 102/20 |
| 2,906,339 | A | 9/1959 | Griffin | 166/35 |
| 3,040,659 | A | 6/1962 | McCullough | 102/20 |
| RE25,407 | E | 6/1963 | Lebourg | 166/35 |
| 3,128,702 | A | 4/1964 | Christopher | 102/20 |
| 3,209,692 | A | 10/1965 | Webb | 102/70 |
| 3,211,093 | A | 10/1965 | McCullough et al. | 102/20 |
| 3,414,071 | A | 12/1968 | Alberts | 175/4.51 |
| 3,415,321 | A | 12/1968 | Venghiattis | 166/35 |
| 3,650,212 | A | 3/1972 | Bauer | 102/20 |
| 4,071,096 | A | 1/1978 | Dines | 175/4.6 |
| 4,191,265 | A | 3/1980 | Bosse-Platiere | 175/4.56 |
| 4,319,526 | A | 3/1982 | DerMott | 102/310 |
| 4,387,773 | A | 6/1983 | McPhee | 175/4.6 |
| 4,393,946 | A | 7/1983 | Pottier et al. | 175/4.56 |
| 4,491,185 | A | 1/1985 | McClure | 175/4.56 |
| 4,523,649 | A | 6/1985 | Stout | 175/4.51 |
| 4,534,423 | A | 8/1985 | Regalbuto | 175/4.6 |
| 4,541,486 | A | 9/1985 | Wetzel et al. | 166/297 |
| 4,583,602 | A | 4/1986 | Ayers | 175/4.52 |
| 4,850,438 | A | 7/1989 | Regalbuto | 175/4.56 |
| 5,046,563 | A | 9/1991 | Engel et al. | 166/297 |
| 5,050,672 | A | 9/1991 | Huber et al. | 166/55 |
| 5,155,293 | A | 10/1992 | Barton | 102/312 |
| 5,216,197 | A | 6/1993 | Huber et al. | 102/317 |
| 5,273,121 | A | 12/1993 | Kitney et al. | 175/4.51 |
| 5,344,011 | A | 9/1994 | DiBernardo et al. | 206/364 |
| 5,449,039 | A | 9/1995 | Hartley et al. | 166/297 |
| 5,619,008 | A | 4/1997 | Chawla et al. | 102/310 |
| 5,797,464 | A | 8/1998 | Pratt et al. | 175/4.6 |

FOREIGN PATENT DOCUMENTS

| | | | |
|---|---|---|---|
| CA | 2243178 | 1/2000 | E21B/43/116 |

OTHER PUBLICATIONS

Innicor, Expendable perforating Gun Jun. 2001.*
LRI Perforating Systems.*

* cited by examiner

*Primary Examiner*—William Neuder
(74) *Attorney, Agent, or Firm*—Davis & Bujold, P.L.L.C.

(57) ABSTRACT

A charge tube assembly for a perforating gun includes a tubular body having opposed ends. Integrally formed engagement members are positioned at each of the opposed ends. Detachable end plates are secured to each of the opposed ends. Each of the end plates has openings engagable with the engagement members.

18 Claims, 9 Drawing Sheets

CHARGE TUBE ASSEMBLY FOR A PERFORATING GUN

FIELD OF THE INVENTION

The present invention relates to a charge tube assembly for a perforating gun.

BACKGROUND OF THE INVENTION

Canadian Patent 2,243,178 (Buzinsky) discloses a charge tube retaining and orienting structure for a perforating gun. The Buzinsky reference describes use in the prior art of disk-form end plates which are held in place by screws. The Buzinsky reference then goes on to teach the use of externally threaded annular disks. These disks are positioned by threading into a threaded end of a carrier tube.

SUMMARY OF THE INVENTION

The present invention relates to an alternative charge tube assembly.

According to the present invention there is provided a charge tube assembly for a perforating gun which includes a tubular body having opposed ends. Integrally formed engagement members are positioned at each of the opposed ends. Detachable end plates are secured to each of the opposed ends. Each of the end plates has openings engagable with the engagement members.

The charge tube assembly, as described above, provides a number of advantages. It does not require screws or other fasteners. There is, therefore, no concern about handling or losing small components in the field. It can be made from thinner material as it does not need to have sufficient thickness to support the machining of an engagement thread. The result is an easy to handle and cost effective alternative to existing charge tube assemblies.

As will be further described with illustrated embodiments, once the basic teachings of the invention are understood the configuration of engagement member and configuration of detachable end plate can vary.

A preferred form of engagement which will hereinafter be illustrated and described for the first or upper one of the opposed ends has a peripheral edge with at least two circumferentially spaced inwardly extending axial slots along the peripheral edge forming arcuate engagement members. The engagement members having deformable locking tabs to prevent the accidental displacement of the end plate. One reason that this form of engagement is preferred relates to alignment. When the axial slots are asymmetrically positioned along the peripheral edge, the engagement members must be positioned in a particular orientation in order to engage the end plates. This addresses the alignment issue, as the detachable end plates can only fit in one orientation.

A preferred form of engagement for the second or lower engagement members is hook shaped. By rotation of the end plate when the engagement members are positioned in the openings of the end plate, the engagement members are moved into an engaged positioned engaging the end plate. For those end plates that are rotated into locking engagement, a tool coupling is positioned on the end plate which is adapted to engage a tool. One form of tool coupling will be illustrated, but alternative forms of tool coupling could be used.

An alternative and equally workable form of engagement involves the use of engagement members which are deformable. The engagement members are positioned in the openings of the end plates and then deformed to engage the end plates.

The configuration of the openings in the end plates can vary. An embodiment will hereinafter be illustrated and described in which the openings in the end plates are slots. An embodiments will also hereinafter be illustrated and described in which the openings in the end plates are cavities positioned along an inner sidewall which defines a central bore.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
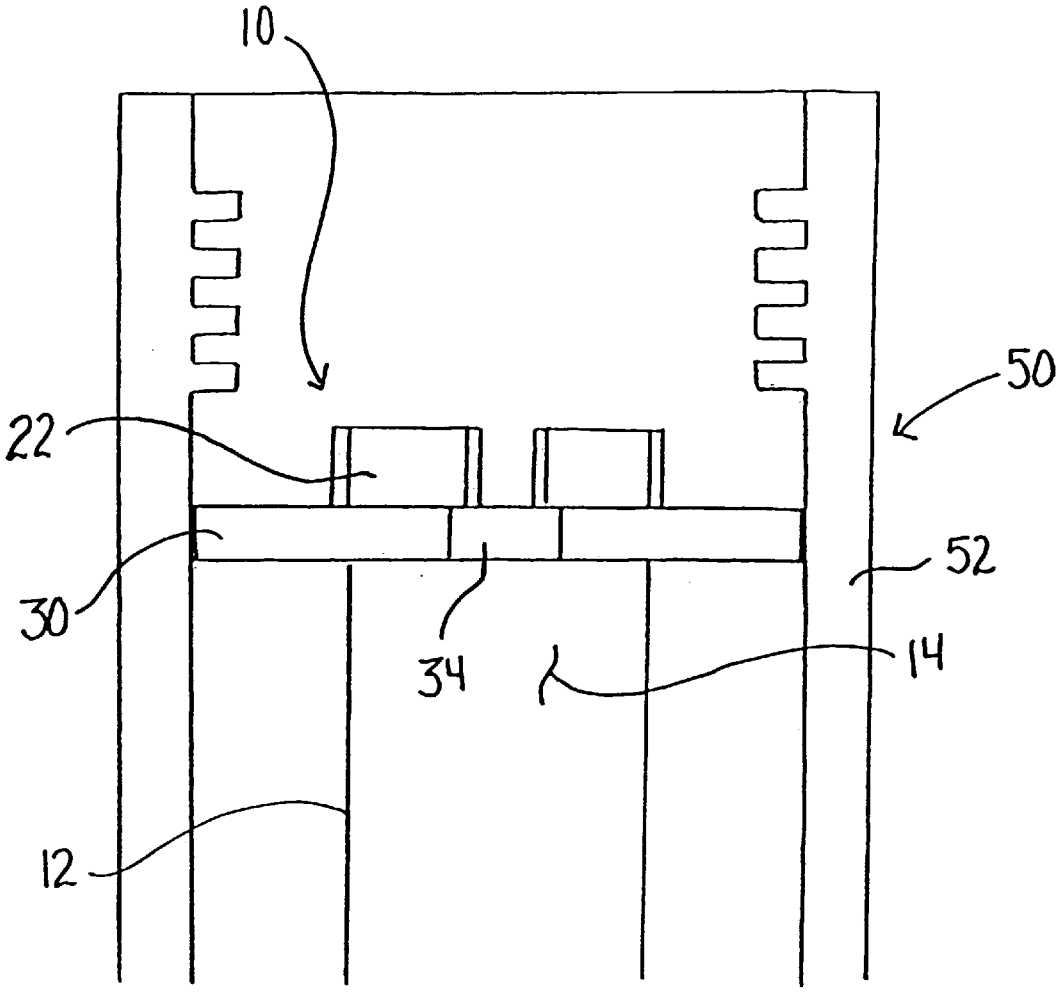
FIG. 1 is a side elevation view, in section, of an upper end of a perforating gun having a charge tube assembly constructed in accordance with the teachings of the present invention.

The preferred embodiment, a charge tube assembly for a perforating gun generally identified by reference numeral 10, will now be described with reference to FIGS. 1 through 14.

Various embodiments of charge tube assembly 10 will be described. All embodiments that will be described have tubular bodies with opposed ends. Integrally formed engagement members are formed at each of the opposed end. Detachable end plates are secured to each of the opposed ends. Each of the end plates has openings engagable with the engagement members. The embodiments have been selected to demonstrate that the form of engagement members and the form of end plates can vary widely.

Structure and Relationship of Parts

Figure 2:
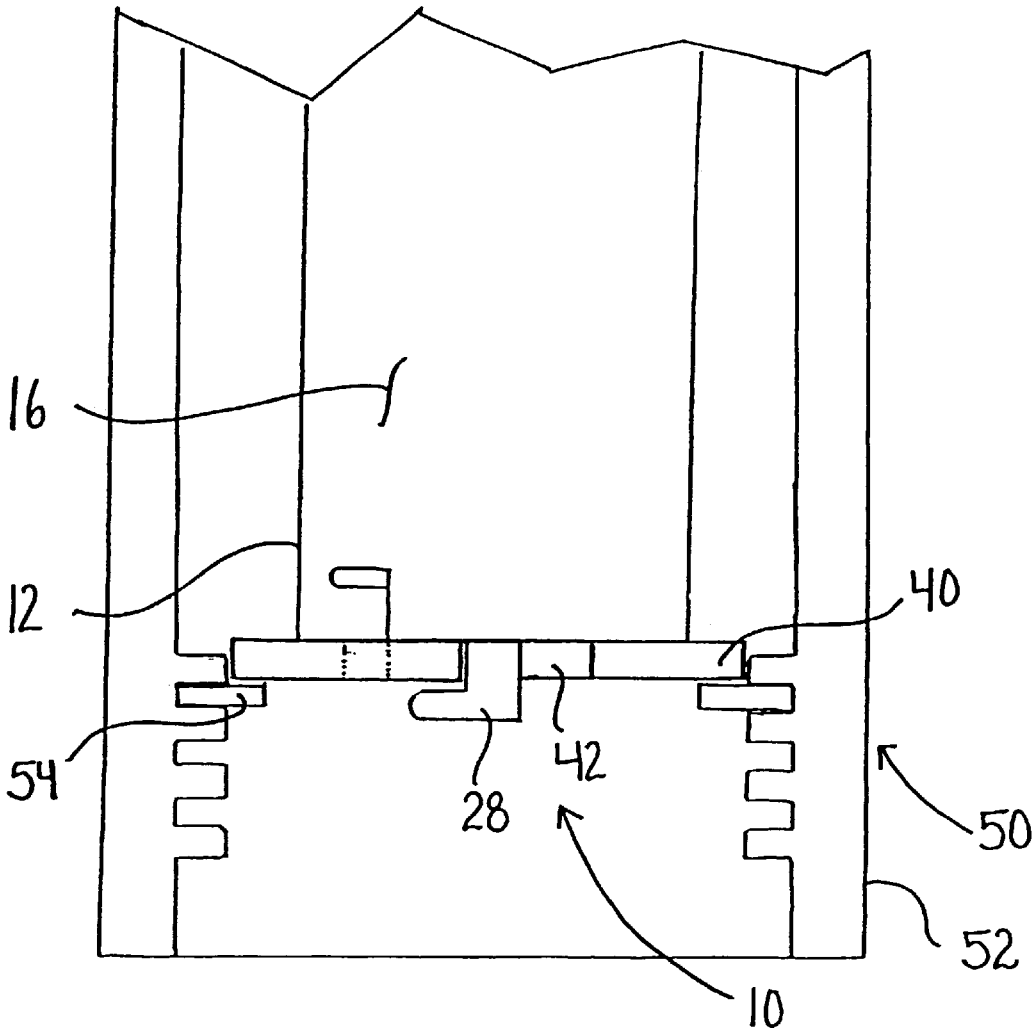
FIG. 2 is a side elevation view, in section, of a lower end of a perforating gun having a charge tube assembly constructed in accordance with the teachings of the present invention.
Figure 3:
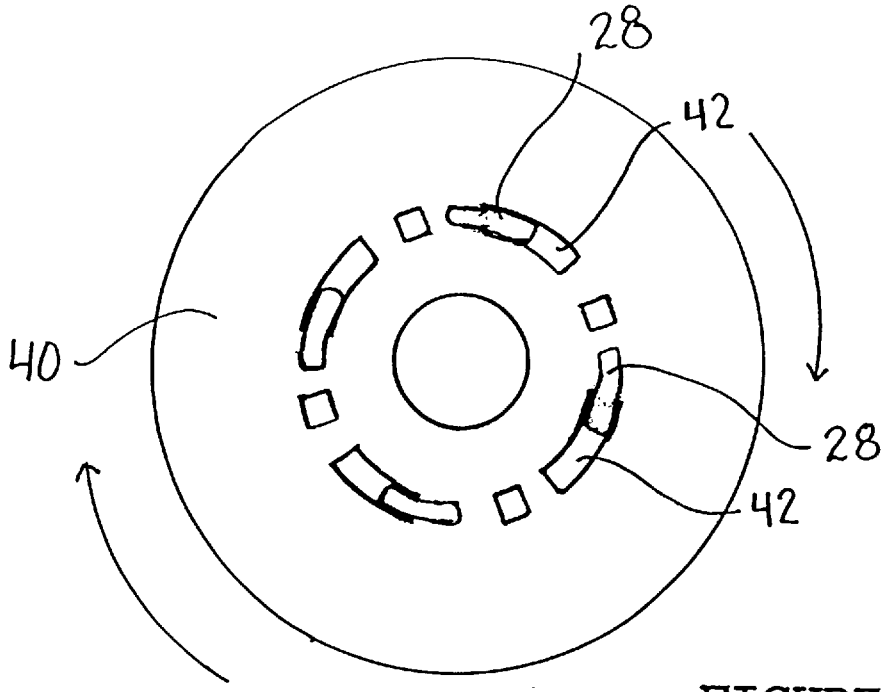
FIG. 3 is bottom plan view of the charge tube assembly illustrated in FIG. 2.
Figure 4:
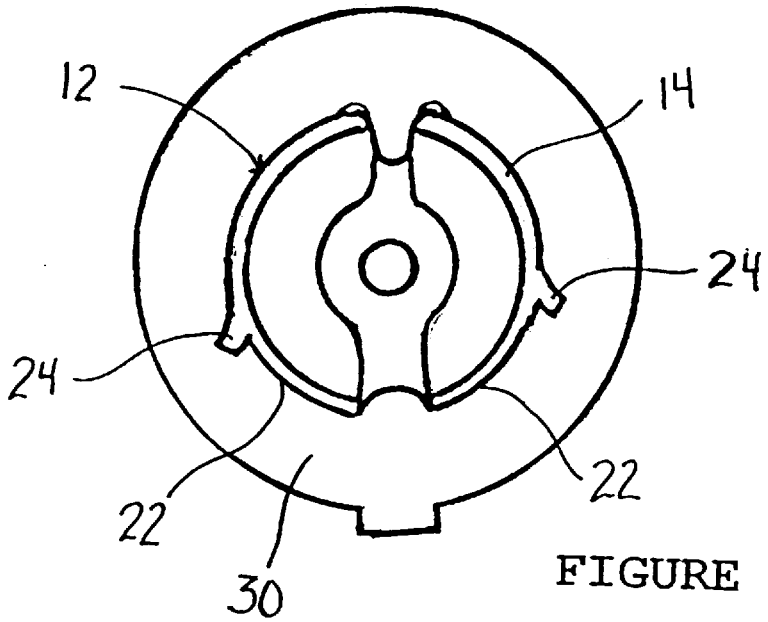
FIG. 4 is top plan view of the charge tube assembly illustrated in FIG. 1.
Figure 5:
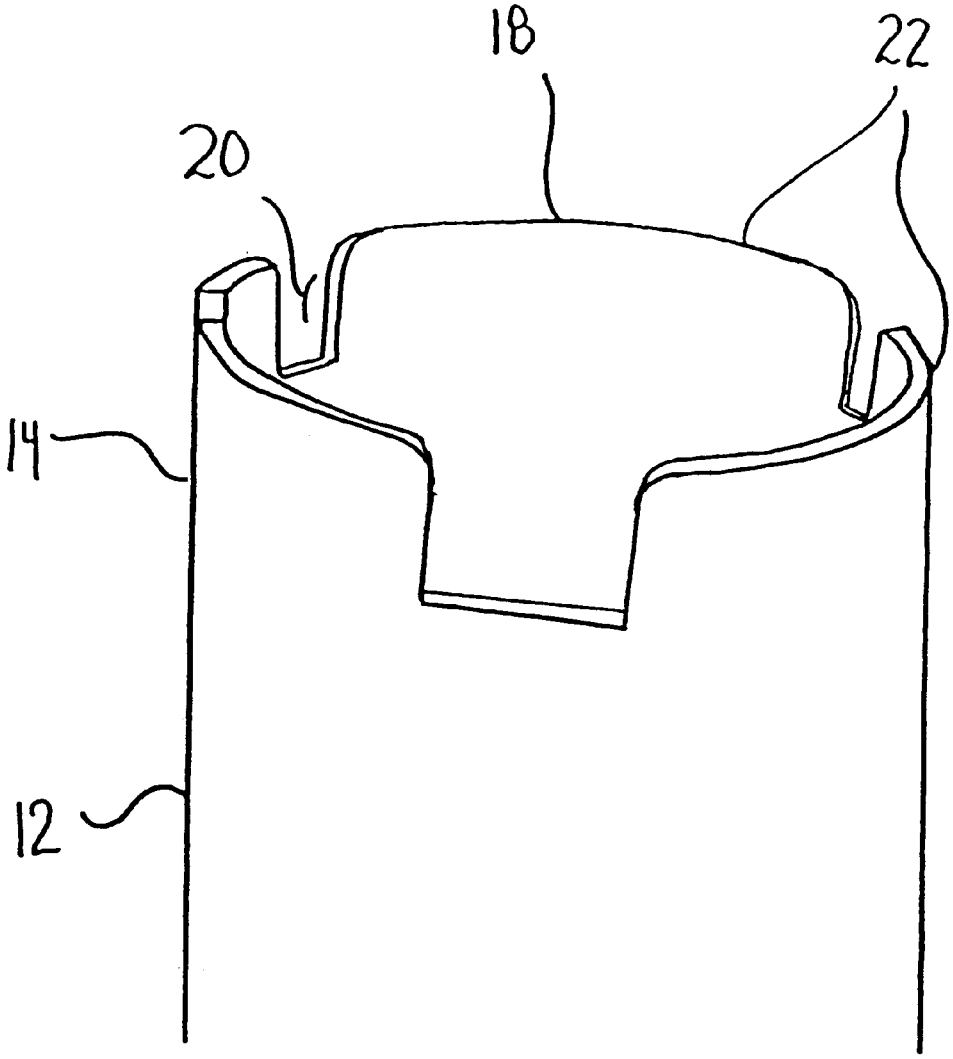
FIG. 5 is perspective view of an upper end of a tubular body forming part of the charge tube assembly illustrated in FIG. 1.
Figure 6:
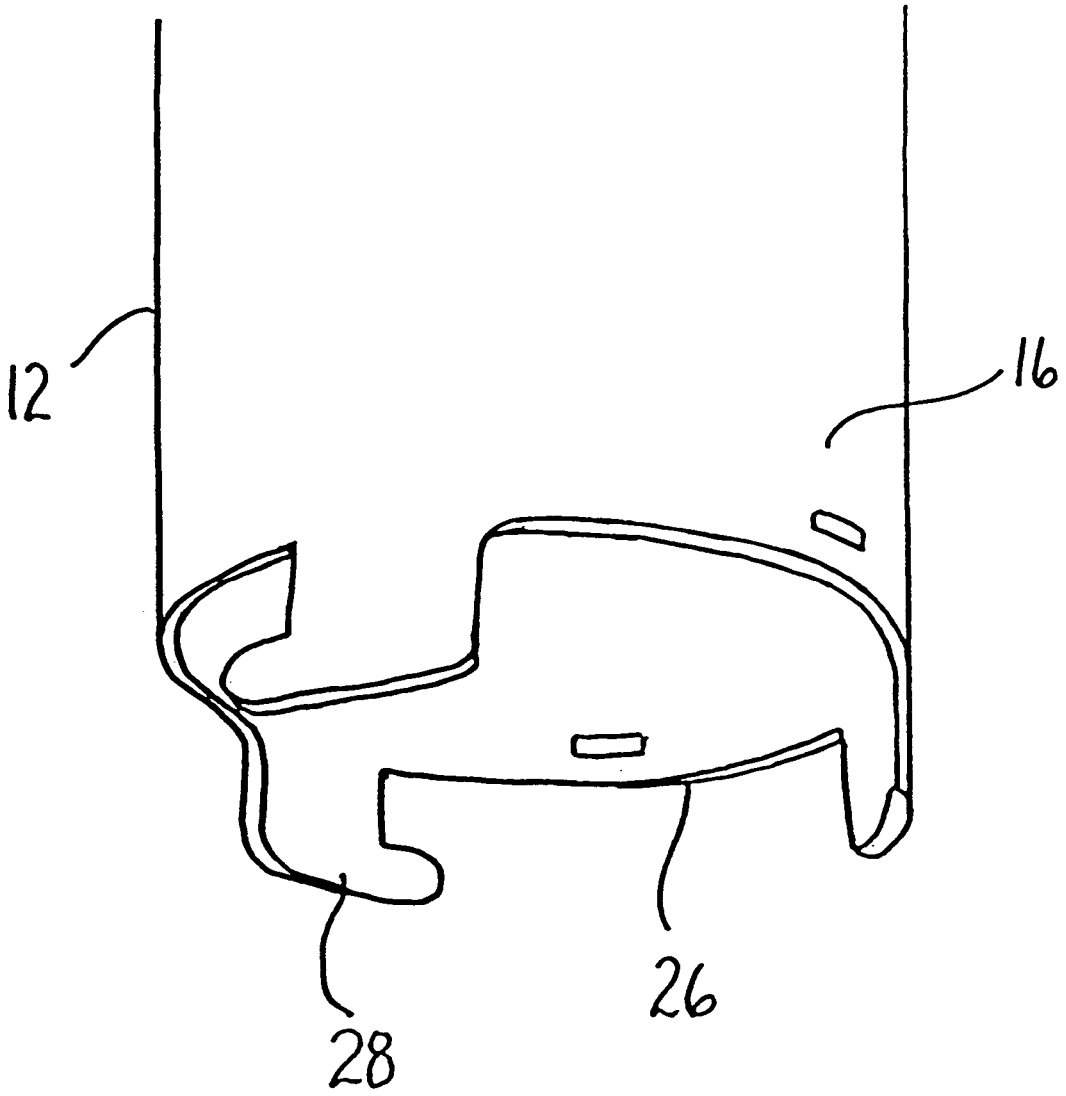
FIG. 6 is perspective view of a lower end of the tubular body forming part of the charge tube assembly illustrated in FIG. 2.
Figure 7:
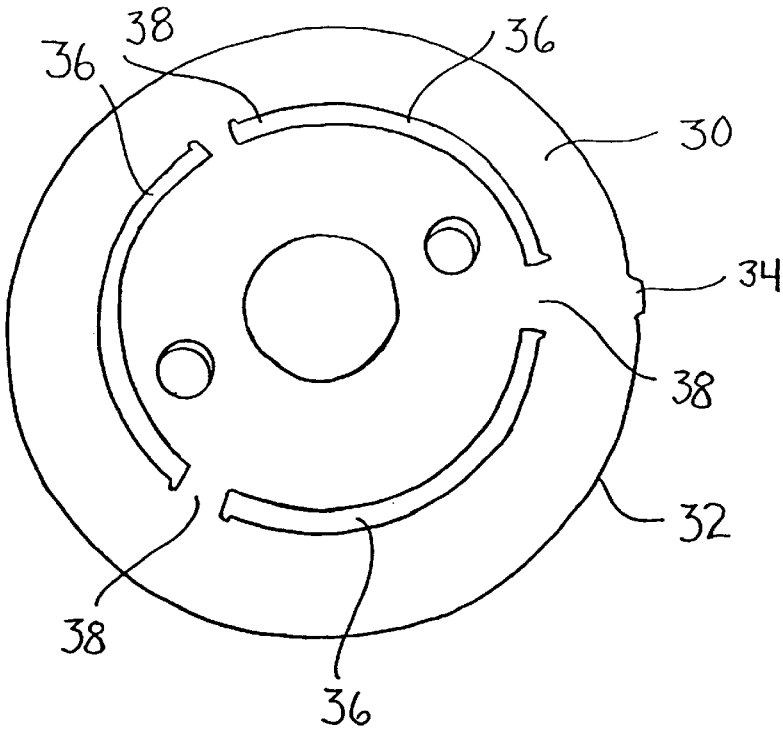
FIG. 7 is top plan view of an upper or first end plate forming part of the charge tube assembly illustrated in FIG. 1.
Figure 8:
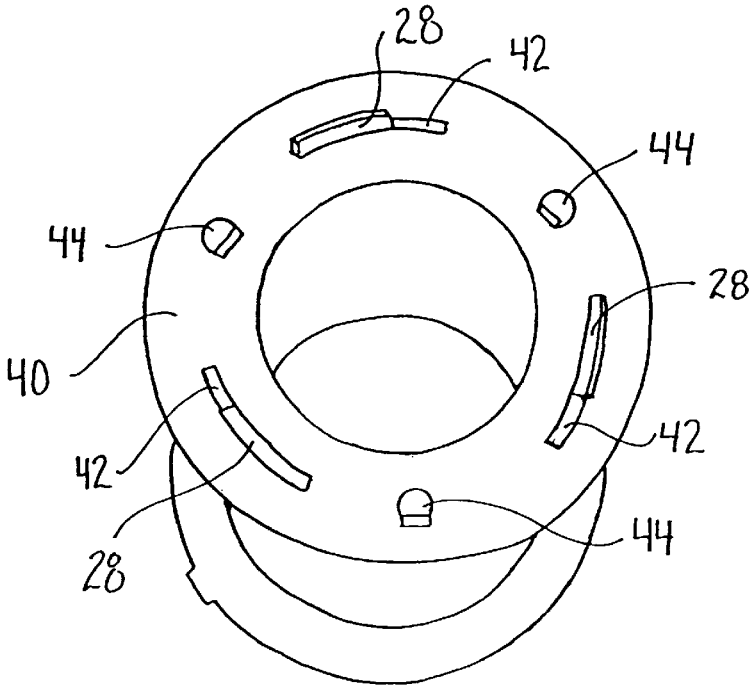
FIG. 8 is bottom plan view of a lower or second end plate forming part of the charge tube assembly illustrated in FIG. 2.
Figure 9:
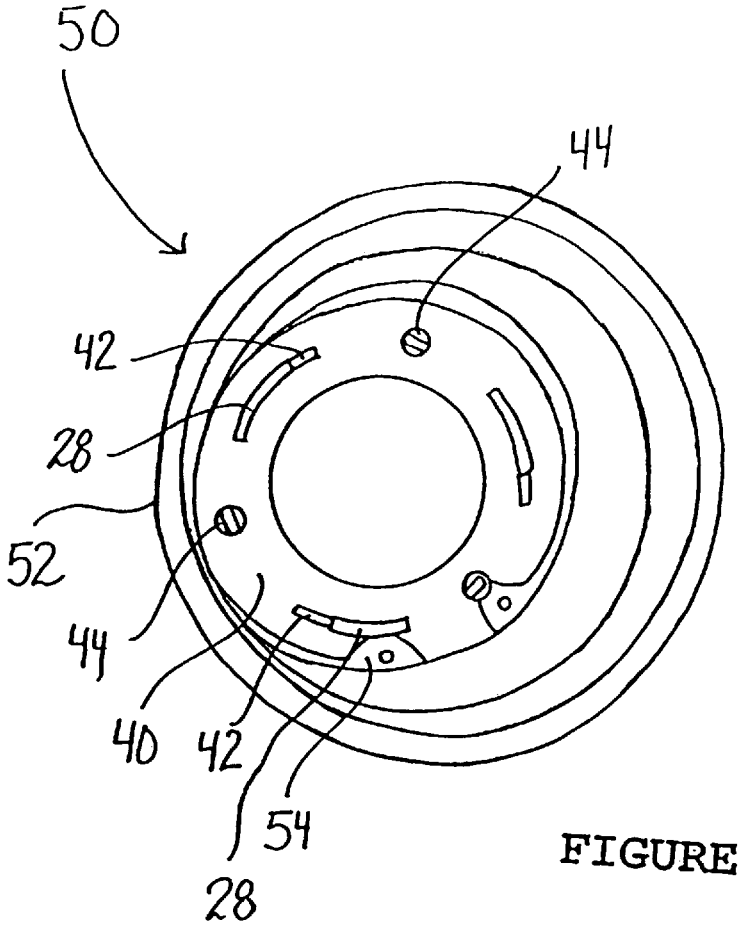
FIG. 9 is bottom perspective view of the charge tube assembly illustrated in FIG. 2, positioned within a perforating gun.
Figure 10:
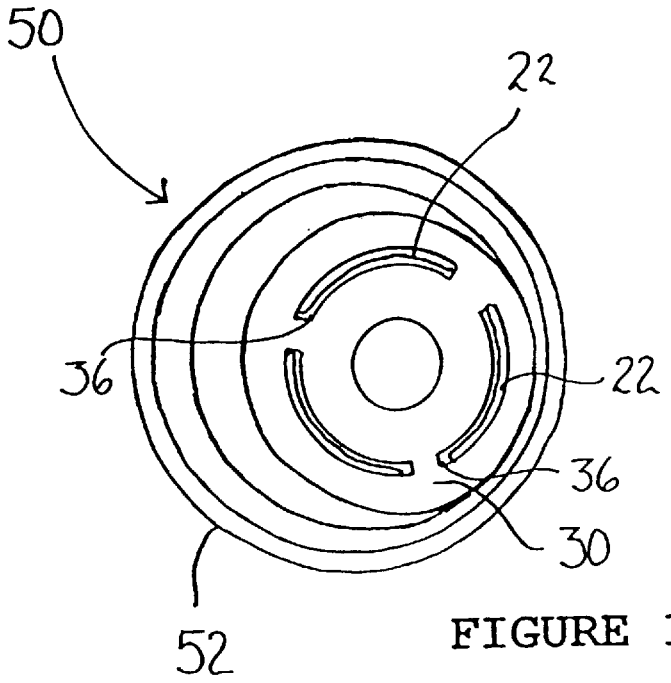
FIG. 10 is top perspective view of the charge tube assembly illustrated in FIG. 1, positioned within a perforating gun.

Referring to FIGS. 1 and 2, charge tube assembly 10 includes a tubular body 12 having an upper or first end 14 as illustrated in FIG. 1 and a lower or second end 16, as illustrated in FIG. 2. Referring to FIG. 5, first end 14 of body 12 has a peripheral edge 18 with three circumferentially spaced inward extending axial slots 20. Slots 20 divide peripheral edge 18 into three integrally formed arcuate first engagement members 22. Referring to FIG. 4, first engagement members 22 have deformable locking tabs 24, as will be hereinafter further described. Referring to FIG. 6, second end 16 of body 12 has a second peripheral edge 26 with circumferentially spaced integrally formed hook form second engagement members 28. Referring to FIGS. 1 and 4, a disk form detachable first end plate 30 is adapted to mate with first end 14 of body 12. Referring to FIG. 7, first end plate 30 has a first outer circumferential edge 32 with an outwardly extending alignment key 34. A three arcuate slotted first openings 36 are provided. Referring to FIGS. 1 and 4, first openings 36 are adapted to receive first engagement members 22, as will hereinafter be further described. Referring to FIG. 7, first end plate 30 has first radially inwardly projecting members 38 adapted to engage the axial slots 20. Referring to FIGS. 5 and 7, it will be noted that each of axial slots 20 are made in different sizes, as are each of radially inwardly projecting members 38. This is done intentionally so that first end plate 30 will only fit onto first end 14 of body 12 in a particular orientation. Referring to FIG. 2, a disk form detachable second end plate 40 is positioned at second end 16 of body 12. Referring to FIG. 8, second end plate 40 has arcuate slotted second openings 42. Referring to FIGS. 2 and 3, second openings 42 are engaged by second engagement members 28. Referring to FIG. 8, second end plate 40 has tool coupling receptacles 44 which are adapted to engage a tool. Referring to FIG. 2 and as will hereinafter be further described, by rotation of second end plate 40 when second engagement members 28 are positioned in second openings 42 of second end plate 40, second engagement members 28 are moved into a locking engagement with second end plate 40.

Operation

The use and operation of charge tube assembly 10 will now be described with reference to FIGS. 1 through 14. Referring to FIGS. 1 and 2, a perforating gun 50 is illustrated that has a barrel 52. Barrels 52 come in various sizes and may be sized from 2⅞ inches up to 5 inches. It is only by selecting the appropriate size of first end plate 30 and second end plate 40 that charge tube assembly 10 can be adapted for use with a particular perforating gun. The outer diameter of first end plate 30 and second end plate 40 must always be selected to fit the inner diameter of barrel 52. In addition, second end plate 40 must have an inner diameter to suit a wireline adaptor or a TCP (tubing conveyed product) adaptor. One of the advantages of the present system is that an inventory of detachable end plates can be readily maintained and quickly attached to body 12 to suit the size requirements of the intended application. Having selected an appropriate size of first end plate 30 and second end plate 40, charge tube assembly 10 can be rapidly assembled. Referring to FIG. 1 and 7, first openings 36 of first end plate 30 are slid over first engagement members 22 at first end 14 of body 12. As previously described with reference to FIGS. 5 and 7, each of axial slots 20 are made in different sizes, as are each of radially inwardly projecting members 38. First end plate 30 will, therefore, only fit onto first end 14 of body 12 in a particular orientation. Referring to FIG. 4, once first end plate 30 is in position, tabs 24 on first engagement members 22 are deformed to prevent first end plate 30 from being removed. Second end plate 40 can be just as readily locked into position. Referring to FIG. 2, second openings 42 of second end plate 40 are slid over second engagement members 28. Referring to FIG. 3, second end plate 40 is then rotated to until second end plate 40 is engaged by the hook like portions of second engagement members 28.

Referring to FIGS. 1, 2, 9, 10, once assembled, charge tube assembly 10 must be inserted into barrel 52 of perforating gun 50. Referring to FIG. 1, alignment key 34 is used to ensure the correct orientation of charge tube assembly 10 within barrel 52. Referring to FIG. 2, charge tube assembly is supported from below by a snap ring 54, that engages second end plate 40.

Variations and Alternative Embodiments

Figure 11:
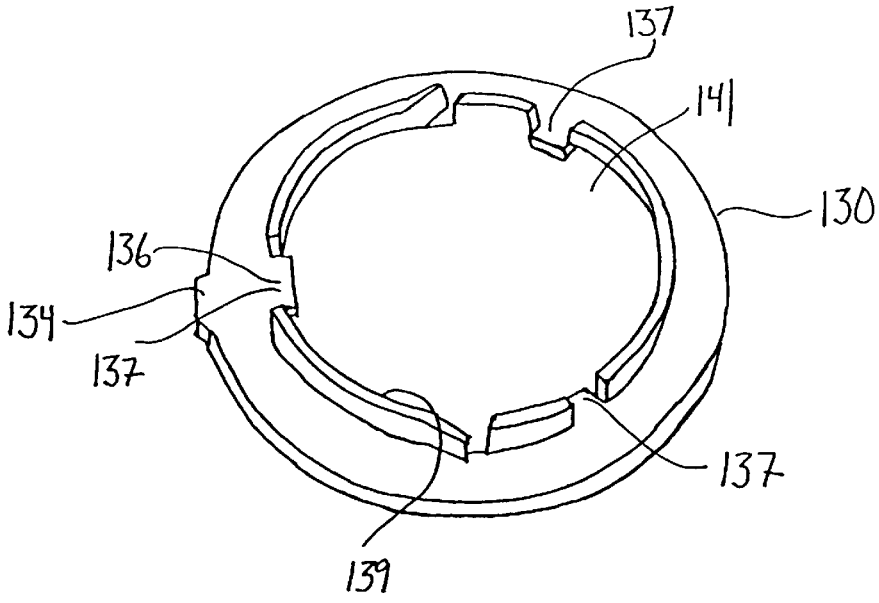
FIG. 11 is a perspective view of an alternative configuration of upper or first end plate.
Figure 12:
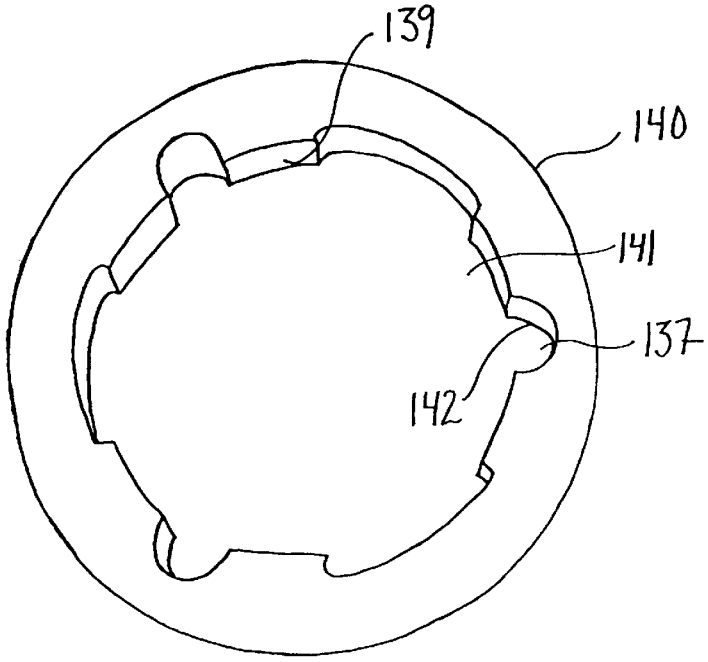
FIG. 12 is a perspective view of an alternative configuration of lower or second end plate.
Figure 13:
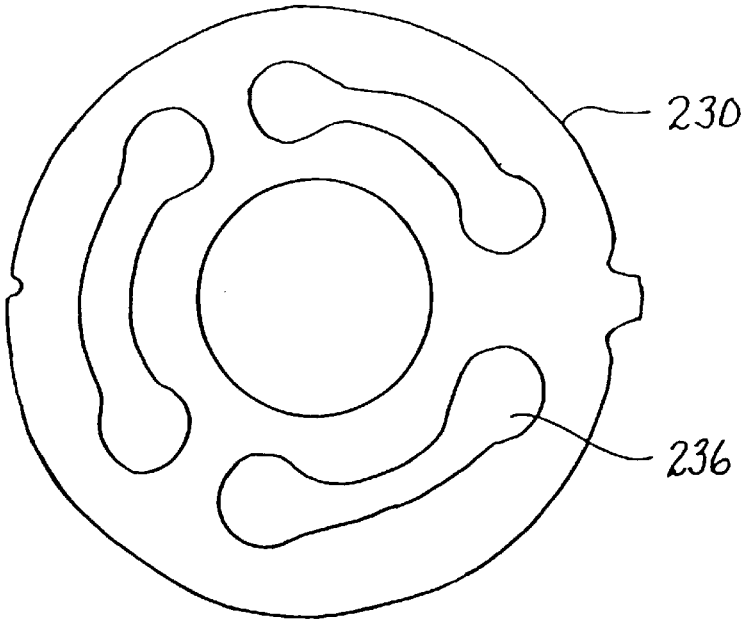
FIG. 13 is a top plan view of an alternative configuration of upper or first end plate.
Figure 14:
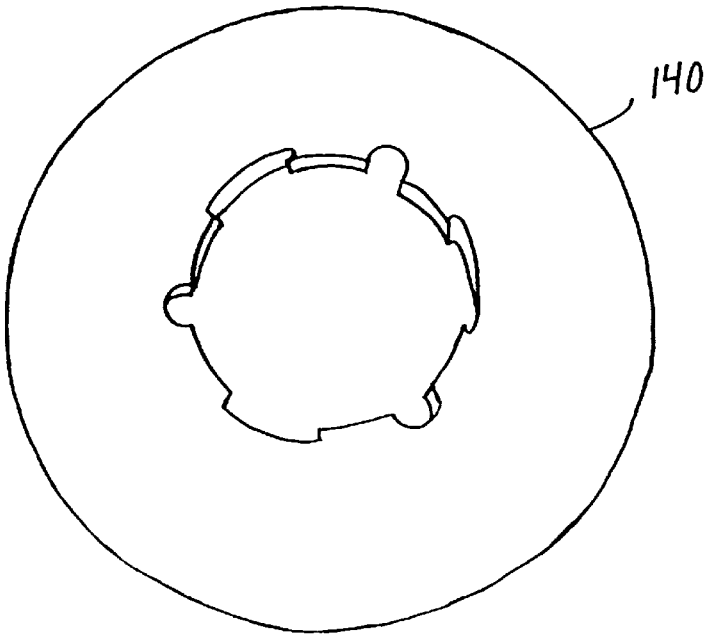
FIG. 14 is a perspective view of an alternative configuration of lower or second end plate.

FIGS. 11 shows an alterative form of first end plate, identified by reference numeral 130. FIGS. 12 and 14 show different sizes of an alternative form of second end plate, identified by reference numeral 140. Referring to FIG. 11 first end plate 130 has first openings 136 to receive first engagement members 22. However, the configuration of first openings 136 differs from first openings 36 in first end plate 30. First openings 136 in first end plate 130 are cavities 137 positioned along an inner sidewall 139 which defines a central bore 141. Referring to FIG. 12, second end plate 140 has second openings 142. However, the configuration of second openings 142 differs from second openings 42 in second end plate 40. Second openings 142 in second end plate 140 are cavities 137 positioned along an inner sidewall 139 which defines a central bore 141. Referring to FIG. 13, an alternative form of first end plate 230 is shown with openings 236 that have a different shape and which are not of uniform dimensions.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A charge tube assembly for a perforating gun, comprising:

a tubular body having a first end and a second end;

integrally formed engagement members at each of the first end and the second end; and detachable end plates at each of the first end and the second end, each of the end plates having openings engagable with the engagement members.

2. The charge tube assembly as defined in claim 1, wherein at least one of the first end and the second end has a peripheral edge with at least two circumferentially spaced inward extending axial slots which divide the peripheral edge to form at least two arcuate engagement members, the engagement members having deformable locking tabs.

3. The charge tube assembly as defined in claim 2, wherein the axial slots are of different sizes, thereby requiring the end plates to be positioned in particular orientation relative to the first end and the second end.

4. The charge tube assembly as defined in claim 1, wherein the engagement members are hook shaped, such that by relative rotation of one of the end plates and the second end of the body when the engagement members are positioned in the openings of the end plate, the engagement members are moved between an engaged positioned engaging one of the end plates and a disengaged position.

5. The charge tube assembly as defined in claim 4, wherein the end plates, positioned at the second end, has a tool coupling adapted to engage a tool.

6. The charge tube assembly as defined in claim 1, wherein the engagement members are deformable, such that by positioning the engagement member in the openings of one of the end plates and then deforming the engagement members, the first end and the second end of the body can be engaged with the end plates.

7. The charge tube assembly as defined in claim 1, wherein the openings in the end plates are slots.

8. The charge tube assembly as defined in claim 1, wherein the openings in the end plates are cavities positioned along an inner sidewall which defines a central bore.

9. A charge tube assembly for a perforating gun, comprising:

a tublar body having a first end and a second end, the first end having a peripheral edge with at least two circumferentially spaced inward extending axial slots which divide the peripheral edge to form at least two integrally formed arcuate first engagement members, the first engagement members having deformable locking tabs;

the second end having circumferentially spaced integrally formed second engagement members; and a disk form detachable first end plate adapted to mate with the first end of the body, the first end plate having a first outer circumferential edge with an outwardly extending alignment key, first openings adapted to receive the first engagement members and first radially inwardly projecting members adapted to engage the axial slots, the axial slots being of different sizes thereby requiring the first end to be positioned in a particular orientation relative to the first end plate; and a disk form detachable second end plate at the second end, the second end plate having second openings engagable with the second engagement members.

10. The charge tube assembly as defined in claim 9, wherein the second engagement members are hook shaped, such that by rotation of the second end plate when the second engagement members are positioned in the second openings of the second end plate, the second engagement members are moved into a locking engagement with the second end plate.

11. The charge tube assembly as defined in claim 10, wherein the second end plate has a tool coupling adapted to engage a tool.

12. The charge tube assembly as defined in claim 9, wherein the second engagement members are deformable, such that by positioning the second engagement members in the second openings of the second end plate and then deforming the engagement members, the second end of the body is engaged with the second end plate.

13. The charge tube assembly as defined in claim 9, wherein the first openings in the first end plate are slots.

14. The charge tube assembly as defined in claim 10, wherein the second openings in the second end plate are slots.

15. The charge tube assembly as defined in claim 9, wherein the first openings in the first end plate are cavities positioned along an inner sidewall which defines a central bore.

16. The charge tube assembly as defined in claim 12, wherein the second openings in the second end plate are cavities positioned along an inner sidewall which defines a central bore.

17. A charge tube assembly for a perforating gun, comprising:

a tubular body having a first end and a second end;

the first end having a peripheral edge with at least two circumferentially spaced inward extending axial slots which divide the peripheral edge to form at least two integrally formed arcuate first engagement members, the first engagement members having deformable locking tabs;

the second end habing a second peripheral edge with circumferentially spaced integrally formed hook form second engagement members; and a disk form detachable first end plate adapted to mate with the first end of the body, the first end plate having a first outer circumferential edge with an outwardly extending alignment key, arcuate slotted first opening adapted to receive the first engagement members and first radially inwardly projecting members adapted to engage the axial slots, the axial slots being different sizes thereby requiring the first end to be positioned in a particular orientation relative to the first end plate; and a disk form detachable second end plate at the second end, the second end plate having arcuate slotted second openings engagable with the second engagement members, the second end plate having tool coupling receptacles adapted to engage a tool, such that by rotation of the second end plate when the second engagement members are positioned in the second openings of the second end plate, the seecond engagement members are moved into a locking engagement with the second end plate.

18. A charge tube assembly for a perforating gun, comprising:

a tubular body having a first end and a second end;

the first end having a peripheral edge with at least two circumferentially spaced inward entending axial slots which divide the peripheral edge to form at least two integrally formed arcuate first engagement members, the first engagement members having deformable locking tabs;

the second end having circumferentially spaced integrally formed second engagement members; and a disk form detachable first end plate adapted to mate with the first end of the body, the first end plate having a first outer circumferential edge with an outwardly extending alignment key, first openings adapted to receive the first engagement members and first radially inwardly projecting members adapted to engage the axial slots, the first openings in the first end plate being cavities positioned along an inner sidewall which defines a central bore, the axial slots being different sizes thereby requiring the first end to be positioned in a particular orientation relative to the first end plate; and a disk form detachable second end plate at the second end, the second end plate having second openings engagable with the second engagement members, the second openings in the second end plate being cavities positioned along an inner sidewall which defines a central bore, the second engagement members being deformable, such that by positioning the second engagement members in the second openings of the second end plate and then deforming the engagement members, the second end of the body is engaged with the second end plate.

* * * * *